US005431352A

United States Patent [19]

Sugioka

[11] Patent Number: 5,431,352

[45] Date of Patent: Jul. 11, 1995

[54] YARN WINDING APPARATUS OF AN AUTOMATIC BOBBIN CHANGING TYPE

[75] Inventor: Takami Sugioka, Matsuyama, Japan

[73] Assignee: Teijin Seiki Co., Ltd., Osaka, Japan

[21] Appl. No.: 50,661

[22] Filed: Apr. 22, 1993

[30] Foreign Application Priority Data

Apr. 23, 1992 [JP] Japan ..... 4-129939

[51] Int. Cl.[6] ..... B65H 54/40

[52] U.S. Cl. ..... 242/18 A; 242/25 A

[58] Field of Search ..... 242/18 A, 25 A, 35.5 A

[56] References Cited

U.S. PATENT DOCUMENTS

| | | | |
|---|---|---|---|
| 2,789,774 | 4/1957 | Petersen et al. | 242/18 A |
| 3,682,403 | 8/1972 | Willis | 242/18 A |
| 3,741,490 | 6/1973 | Venot | 242/18 A |
| 3,940,077 | 2/1976 | Ohashi | 242/35.5 A |
| 3,999,715 | 12/1976 | Schippers et al. | 242/18 A |
| 4,079,898 | 3/1978 | Murakami et al. | 242/35.5 A |
| 4,298,171 | 11/1981 | Fluckiger et al. | 242/18 A |
| 4,555,068 | 11/1985 | Kamp | 242/36 |
| 4,564,123 | 1/1986 | Noshi | 221/11 |
| 4,591,105 | 5/1986 | Niederer | 242/18 A |
| 4,615,493 | 10/1986 | Teranishi et al. | 242/35.5 A |
| 4,805,846 | 2/1989 | Ueda et al. | 242/36 |
| 4,844,358 | 7/1989 | Kamp | 242/35.5 R |
| 4,984,749 | 1/1991 | Matsui et al. | 242/35.5 R |
| 5,029,762 | 7/1991 | Behrens et al. | 242/18 A |
| 5,046,224 | 9/1991 | Bogucki-Land et al. | 28/190 |
| 5,102,060 | 4/1992 | Busenhart | 242/18 A |
| 5,246,177 | 9/1993 | Sugioka | 242/18 A |

FOREIGN PATENT DOCUMENTS

| | | |
|---|---|---|
| 263389 | 4/1988 | European Pat. Off. . |
| 470593 | 2/1992 | European Pat. Off. . |
| 874945 | 4/1953 | Germany . |
| 2364284 | 4/1975 | Germany . |
| 2365384 | 5/1975 | Germany . |
| 2065654 | 7/1976 | Germany . |
| 3308454 | 9/1984 | Germany . |
| 3624904 | 1/1988 | Germany . |
| 3731748 | 4/1989 | Germany . |
| 48-19571 | 6/1973 | Japan . |
| 51-30173 | 8/1976 | Japan . |
| 57-25466 | 5/1982 | Japan . |
| 58-42106 | 9/1983 | Japan . |
| 2-4504 | 1/1990 | Japan . |
| 63-57477 | 3/3988 | Japan . |
| 199091 | 10/1965 | Sweden . |
| 663400 | 12/1987 | Switzerland . |
| 2039552 | 8/1980 | United Kingdom . |

OTHER PUBLICATIONS

Papier+Kunststoff-Verarbeiter, vol. 23, No. 2, Feb. 1988, Frankfort A/M Germany, pp. 18-20.

*Primary Examiner*—Daniel P. Stodola
*Assistant Examiner*—William Stryjewski
*Attorney, Agent, or Firm*—Rothwell, Figg, Ernst & Kurz

[57] ABSTRACT

A machine frame has a traverse device and a frame having a contact roller movably mounted thereon. A first slider guide member is substantially vertically disposed below the contact roller, and a second slider guide member is pivoted on a shaft spaced from the lower end of the first slider guide member, sliders are slidable along the slider guide members, carriers are connectable with and detachable from the sliders, and the carriers have bobbin holders rotatably mounted thereon. The bobbin holders move to a winding position, doffing position and stand-by position while the bobbin holders and carriers are transferred between the sliders of the slider guide members.

10 Claims, 11 Drawing Sheets

YARN WINDING APPARATUS OF AN AUTOMATIC BOBBIN CHANGING TYPE

BACKGROUND OF THE INVENTION

Technical Field of the Invention

The present invention relates to an apparatus of a bobbin changing type for winding a yarn, such as a synthetic yarn, at a high speed, which apparatus is provided with two bobbin holders, and in which when a package wound on one of the bobbin holders reaches a predetermined amount, winding of the yarn is changed to another bobbin on the other bobbin holder.

As disclosed in Japanese Patent Publication No. Sho 57-25466, a conventionally known yarn winding apparatus of an automatic bobbin changing type is provided with two bobbin holders projecting from a turret table formed in a circular disc and spaced a predetermined distance from each other. When a package wound on one of the bobbin holders reaches a predetermined amount, the turret table is turned around a central axis upon changing of winding of the yarn.

According to another apparatus, disclosed in Japanese Patent Application Laid-open No. Sho 63-57477, two bobbin holders are independently and pivotably supported between a winding position and a stand-by position, and a friction roller is selectively in contact with one of the two bobbin holders.

According to the apparatus disclosed in the Japanese Patent Publication No. Sho 57-25466, two bobbin holders project from the circular turret table at predetermined spaced positions, and when a package wound on one of the bobbin holders reaches a predetermined amount, the turret table is turned with the two bobbin holders.

Accordingly, a large space is required for installing such a winding apparatus, and thus the distance between adjacent winding apparatus must also be large, and consequently, a large amount of space required for installing a large number of winding apparatus.

The apparatus disclosed in Japanese Patent Application Laid-open No. Sho 63-57477 requires a large space which is twice that required for an apparatus of a manual changing type since two bobbin holders are independently and pivotably supported between a winding position and a stand-by position.

The present inventor previously proposed in U.S. patent application Ser. No. 975,965, now U.S. Pat. No. 5,246,177, a yarn winding apparatus of an automatic bobbin changing type, by which the above-described problems can be obviated and the space required for installation can be minimized. The proposed apparatus is provided with a plurality of bobbin holders, and when a package wound on one of the bobbin holders reaches a predetermined amount, winding of the yarn is changed to another bobbin holder. The apparatus comprises:

- a path formed along a closed loop for guiding the plurality of bobbin holders along a winding position, a doffing position, an empty bobbin donning position, a stand-by position, a changing position and the winding position; and
- a means for independently moving the plurality of bobbin holders along the bobbin holders guiding path.

The proposed automatic bobbin changing apparatus can achieve the intended objects of minimization of the space required for installation. However, the apparatus uses an endless gear means for independently moving the plurality of bobbin holders along the bobbin holders guiding path and chains for moving the bobbin holders along the endless gear means. Further, since the endless gear means have to be disposed for the two bobbin holders, respectively, they have to be stacked in parallel on the winding apparatus. Thus, there is a problem in that the construction of the proposed apparatus is very complicated. In addition, when the bobbin holders are moved, they are moved along the endless gear means at all positions on the bobbin holder guiding path formed in a closed loop, and thus, the precision of the movement is substantially the same regardless of the positions on the guiding path. In other words, the highly precise control of bobbin holder movement which is required around the winding position is also achieved for the rest of the guiding path, and accordingly, the control means is very expensive.

OBJECTS OF THE INVENTION

It is an object of the present invention to obviate the problems inherent to the winding apparatus proposed in the above-mentioned U.S. Pat. No. 5,246,177.

It is another object of the present invention to provide an apparatus of a bobbin changing type for winding a yarn, by which not only the installation space can be minimized, but also the manufacturing cost can be reduced yet highly precise control upon winding can be achieved.

SUMMARY OF THE INVENTION

According to the present invention, the above-described objects are achieved by a yarn winding apparatus of an automatic bobbin changing type provided with two bobbin holders, wherein a yarn is traversed while a contact roller is in contact with at least one bobbin inserted onto one of the bobbin holders, and when a package wound on the bobbin reaches a predetermined amount, winding of the yarn is changed to at least one bobbin inserted onto the other bobbin holder. The apparatus further comprises:

- a first slider guide means for guiding the bobbin holders;
- a second slider guide means for guiding the bobbin holders;
- sliders disposed so as to be movable along the first and second slider guide means; and
- carriers mounting the bobbin holders thereon which are capable of being transferred between the sliders on the first and second slider guide means.

The first slider guide means may be so constructed that it guides the bobbin holders from a winding position to a doffing position. Further, the second slider guide means may be so constructed that it guides the bobbin holders, which have been guided to the doffing position by the first slider guide means, from the doffing position or a position near the doffing position to a position adjacent to the winding position.

As described with reference to the illustrated embodiment, the first slider guide means may be fixed at a predetermined position, and one end of the second slider guide means may be pivoted so that the second slider guide means can swing between a first position where it is in parallel with the first slider guide means and a second position where it is located away from the first position. In this case, the one end of the second slider guide means is pivoted near the doffing position, and the other end of the second slider guide means may move between a position near the stand-by position and a position near the winding position.

Further, as shown in another embodiment, the first slider guide means may be fixed at a predetermined position, and the second slider guide means may move between a first position where it is in parallel with the first slider guide means and a second position where it is located away from the first position while it is kept in parallel with the first slider guide means.

Furthermore, as shown in still another embodiment, the first and second slider guide means are disposed to form two sides of a substantial V shape, and a third slider guide means may be disposed along an open side of the substantial V-shape, and the third slider guide means may be provided with a slider to and from which the carriers may be transferred. In this case, it is preferred that the peak of the substantial V-shape be located near the doffing position, and the the bobbin holders be transferred from the stand-by position to the winding position by means of the third slider guide means. In addition, a fourth slider guide means may be disposed at the peak of the V-shape, and the fourth slider guide means may be provided with a slider to and from which the carriers may be transferred.

BRIEF DESCRIPTION OF THE DRAWINGS

The present invention will now be explained in detail with reference to the accompanying drawings, wherein.

DETAILED DESCRIPTION OF EMBODIMENTS

Figure 1:
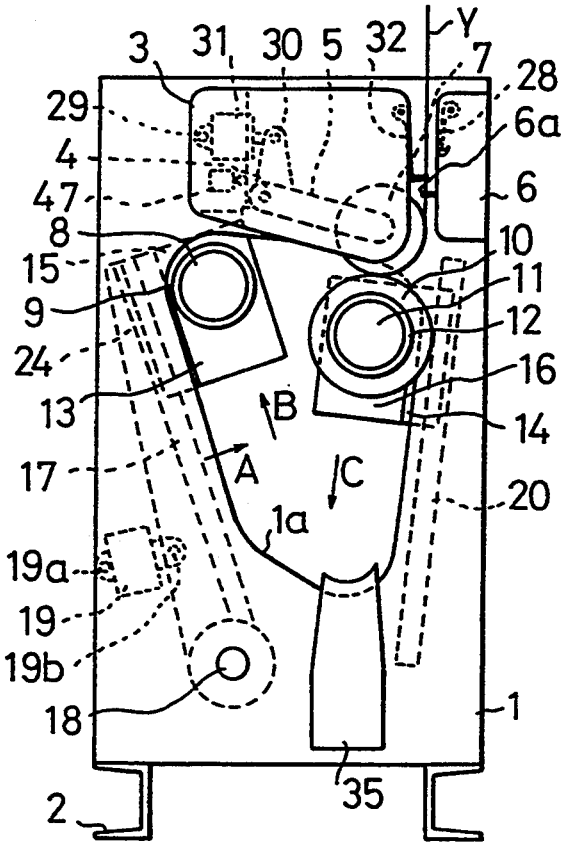
FIG. 1 is an elevation of an embodiment of the present invention.
Figure 2:
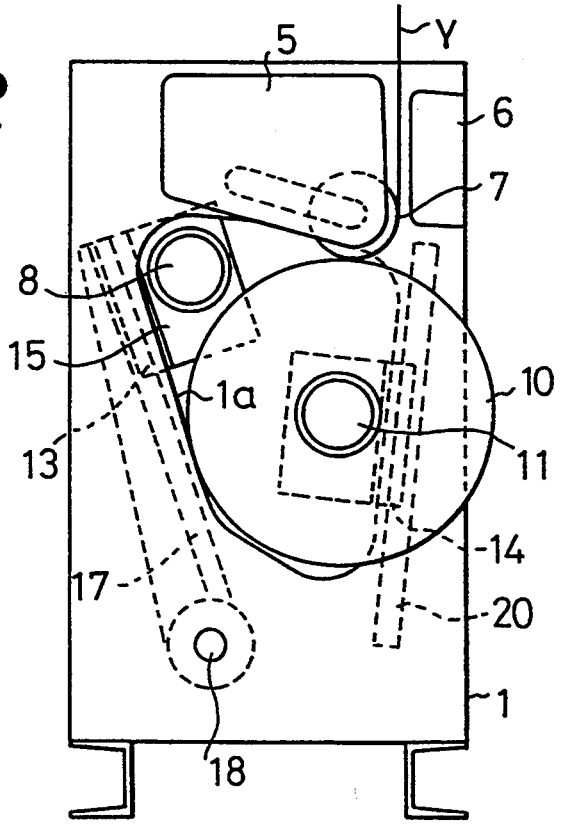
FIGS. 2–8 are elevations sequentially showing the operations of the embodiment illustrated in FIG. 1.
Figure 3:
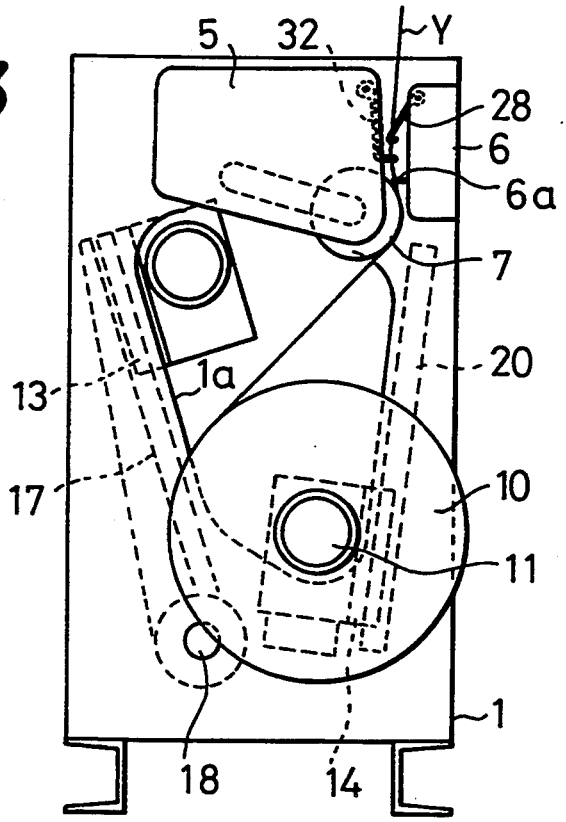
Figure 4:
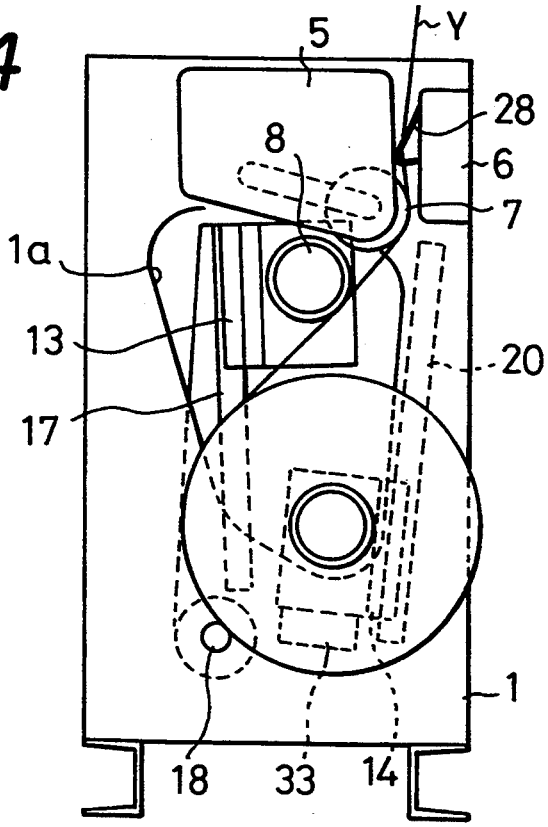

A construction of a yarn winding apparatus of a bobbin changing type according to the present invention will now be explained with reference to the accompanying drawings. FIGS. 1–8 are elevations of an embodiment of the present invention sequentially showing the operations for changing the yarn. A machine frame 1 is mounted on a base 2 comprising a pair of channels and has a frame 5 supported thereon pivotably about a pin 4 in a vertical direction. The frame 5 has a contact roller 7 rotatably supported thereon. The machine frame 1 further has a traverse device 6 projecting therefrom in parallel with the contact roller 7. The traverse device 6 in well known type of this embodiment comprises a cylindrical grooved cam, a slider slidably engaged with a groove of the grooved cam and a yarn guide connected to the slider, and it traverses a yarn by means of the yarn guide. Other conventionally known traverse devices are also applicable in place of the traverse device with the above-described construction.

In FIG. 1, a rear end of a pneumatic cylinder 31 is connected to a support 3 by means of a pin 29, and a piston rod of the pneumatic cylinder 31 is connected to the frame 5. A predetermined amount of compressed air is supplied to the cylinder 31 so that the weights of the frame 5 and the contact roller 7 are supported by the cylinder 31 and a predetermined contact pressure is caused between the contact roller 7 and a bobbin holder 11 on which a yarn is being wound.

The machine frame 1 has an opening 1*a* substantially formed in an inverted triangle and located below the frame 5, and a first slider guide means 20 is fixed within the machine frame 1 adjacent to the right side of the triangle which extends almost along a vertical line. A pivot shaft 18 extending in an axial direction of the bobbin holders 8 and 11 is supported at the lower left position of the opening 1*a* located at the lower portion of the machine frame 1 and pivotably supports a second slider guide means 17. Further, in FIG. 1, a rear end of a pneumatic cylinder 19 is connected to the machine frame 1 by means of a pin 19*a*, and a piston rod of the cylinder 19 is connected to the second slider guide means 17 by means of a pin 19*b*, so that the second slider guide 17 can be swung about the shaft 18 in a direction indicated by an arrow A in FIG. 1 by means of the cylinder 19.

Figure 9:
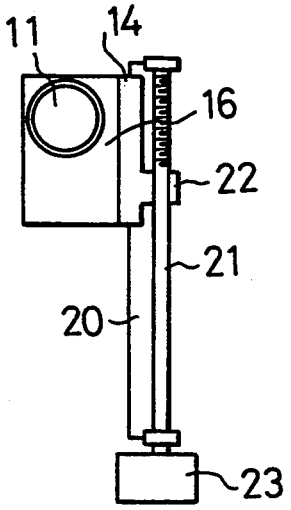
FIGS. 9 and 10 are elevations of a second slider guide means illustrating its drive for moving a slider.
Figure 10:
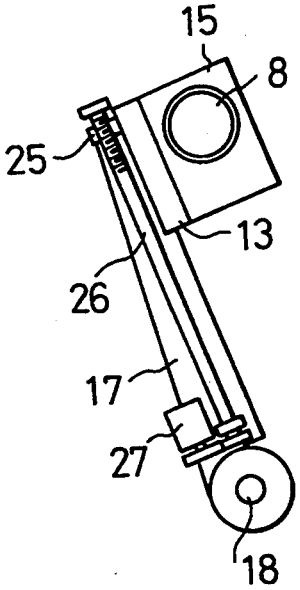

Further, a slider 13 is vertically slidable along the second slider guide means 17, and a slider 14 is vertically slidable along the first slider guide means 20. More specifically, as illustrated in FIG. 9, the slider 14 has a nut 22 fixed thereto, and the nut 22 is threaded with a bolt 21 which is rotatably supported and in parallel with the first slider guide means 20. The bolt 21 is rotated by a stepping motor 23 and the slider 14 is vertically moved in a direction indicated by an arrow C in FIG. 1. Similarly, in FIG. 10, a nut 25 is threaded with a bolt 26 which is rotatably supported on the second slider guide means 17. The bolt 26 is driven by a stepping motor 27 so that the slider 13 is vertically moved in a direction indicated by an arrow B in FIG. 1.

The bobbin holder 8 is supported on a carrier 15 together with a drive motor therefor, and the bobbin holder 11 is supported on a carrier 16 together with another drive motor therefor.

Figure 11:
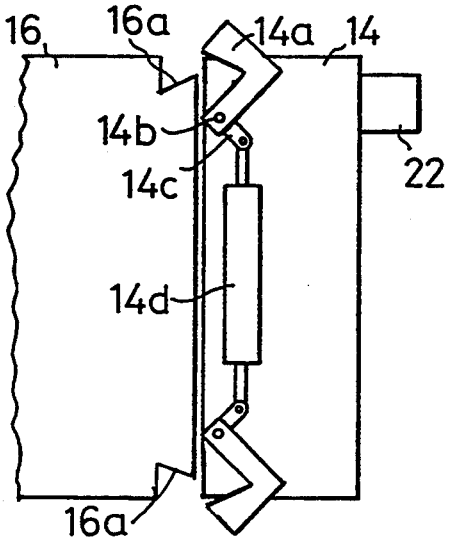
FIG. 11 is a partially enlarged elevation of a carrier connecting means.

FIG. 11 shows an embodiment of a carrier connecting means disposed on the slider 14. The slider 14 has chucks 14*a* formed in a Z-shape and pivoted by pins 14*b* at upper and lower portions thereof. The ends of the chucks 14*a* are connected to ends of piston rods of a fluid pressure cylinder 14*d* with two piston rods. The carrier connecting means disposed on the slider 13 and that disposed on the machine frame 1 have a similar construction.

The carrier 16 also has outwardly extending projections 16*a* at the upper and lower shoulders on the opposite surface thereof with which the turned chucks engage.

Accordingly, when the piston rods of the fluid pressure cylinder 14*d* with two piston rods are moved backwards, the chucks 14*a* of the slider disengage, and the carrier 15 or 16 is released from the slider 13 or 14. When the chucks 14*a* are actuated by the fluid pressure cylinder 14*d* while the carrier 15 or 16 is located at a predetermined position relative to the slider 13 or 14, the carrier 15 or 16 is integrally connected to the slider 13 or 14.

As described above, the carriers 15 and 16 rotatably support the bobbin holders 8 and 11, and the bobbin holders 8 and 11 are connected to drive motors (not shown) which are integrally fixed to the carrier 15 and 16. The carrier 15 or 16 connected to the slider 14 can be lowered from a winding position, where one or more bobbins inserted on the bobbin holder 8 or 11 contact the contact roller 7, to the doffing position, by the movement of the slider 14 along the first slider guide means 20. Further, the carrier 15 or 16 connected to the slider 13 can be moved from the doffing position to a stand-by position near the winding position by the movement of the slider 13 along the second slider guide means 17 and further from the stand-by position to the winding position by the swinging movement of the second slider guide means 17 about the shaft 18.

Upon change of winding of the yarn, a guide device 28 (FIG. 1) restricts the passage of the yarn, which has been released from the yarn guide of the traverse device 6, at a position near one end of the bobbin so as to form bunch windings for transfer tail on the bobbin. The guide device 28 is constructed in a known manner.

The machine frame 1 has a sensor 47, which is designated by a limit switch in FIG. 1, but may be of any conventionally known type, for detecting the amount of movement of the frame 5 provided with the contact roller 7. During winding operation, when the contact roller 7 moves upwardly by a small distance as the size of the wound package 10 increases, the sensor 47 detects the amount of movement, and it lowers the slider 14 provided with the bobbin holder 11, onto which the yarn is wound by a predetermined amount, i.e., it moves the bobbin holder 11 away from the contact roller 7.

In FIG. 1, the bobbin holder 8 waiting at the stand-by position has the bobbin 9 inserted thereon and is supported on the carrier 15 connected to the slider 13, while the bobbin holder 11, onto which package 10 is formed, has the bobbin 12 inserted thereon. The bobbin holders 8 and 11 are driven by the electric motors (not shown), respectively, disposed on the carriers, during winding operation, and their rotating speed is controlled by a controller (not shown) in a known manner so that the speed of the contact roller 7 coincides with a predetermined speed.

After completion of winding, the bobbin holder 8 or 11 is moved to a position for doffing the packages 10, where a plate 35 (FIG. 1), which engages with the bobbins 8 or 11, onto which the package 10 is formed, is pushed in parallel with the bobbin holders 8 and 11 by means of a pneumatic cylinder (not shown) so as to doff the package 10. The bobbin holders 8 and 11 can slide in their axial direction upon completion of winding by means of a pneumatic cylinder (not shown).

The operation of the embodiment constructed as above will now be explained. As the package 10 is formed on the bobbin 12 inserted onto the bobbin holder 11, the contact roller 7 pressed to and contacting the package 10 is moved upwardly by a small distance, and accordingly, the sensor 47 is switched on. Thus, the stepping motor 23 (FIG. 9) is actuated and the bobbin holder 11 is lowered until the sensor 47 is switched off and the operation of the stepping motor 23 is stopped. As the diameter of the wound package increases, the above-described operations are repeated.

When the lowering movement of the bobbin holder 11 starts, the stepping motor 27 is started so that the slider 13, carrier 15 and the bobbin holder 8 are moved to a predetermined stand-by position where the bobbin inserted onto the bobbin holder 8 will contact the contact roller 7 when the second slider guide means 17 is turned about the shaft 18 in a clockwise direction, i.e., in a direction designated by arrow A in FIG. 1.

When the wound amount of the packages 10 reaches a predetermined amount (see FIG. 2), the rotation of the bobbin holder 8 on the slider 13 of the second slider guide means 17 is started, and when the rotating speed of the bobbin holder 8 reaches a predetermined speed, the stepping motor 23 (FIG. 9) is started so that the slider 14, carrier 16 and the bobbin holder 11 are lowered along the first slider guide means 20 so as to move away from the contact roller 7 until the bobbin holder 11 reaches the bobbin doffing position where they are stopped by means of the carrier engaging means 33.

Thereafter, the yarn disengaging guide 28 is swung in a clockwise direction (to the left in FIG. 1) by means of a pneumatic cylinder so that the yarn Y is disengaged from the traverse guide 6*a* of the traverse device 6. The yarn Y is continued to be wound onto the packages 10 while it is restricted by the guide device at a position corresponding to the yarn catching means (grooves formed at the outer peripheries of the paper bobbin in this embodiment) formed on the bobbin 9 near at one end of the package 10 (see FIG. 3).

Figure 5:
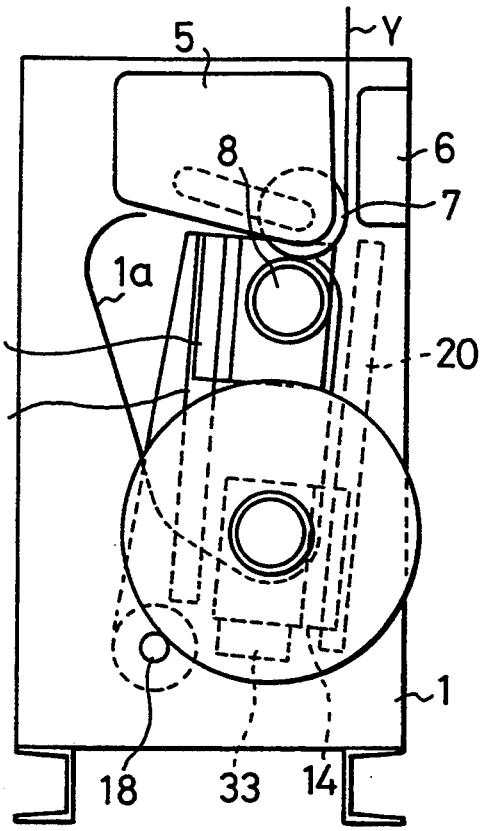

When the second slider guide means 17 is swung about the shaft 18 in a direction indicated by an arrow A, i.e., in a clockwise direction, by means of the cylinder 19 (FIG. 1), the bobbin 9 inserted onto the bobbin holder 8 contacts the yarn extending between the contact roller 7 and the package 10, and the extending yarn is caught by the yarn catching means on the bobbin 9, and then the bobbin holder 8 is stationary and located at a predetermined position. During this operation, a small amount of bunch windings are formed near the yarn catching means (see FIG. 4). The second slider guide means 17 is swung until it is in parallel with the first slider guide means 20 as illustrated in FIG. 5. Then, the transfer tail is formed on the bobbin by the relative movement in an axial direction of the guide device 28 and the bobbin holder 8. When the axial movement of the bobbin holder 8 is completed, the yarn Y is disengaged from the guide device 28 and is engaged with the yarn guide 6*a* of the traverse device 6. The yarn Y is traversed by the traverse device 6. (see FIG. 5).

When the changing operation is completed, the rotation of the bobbin holder 11 supported on the slider 14 is stopped by means of a braking device (not shown).

Figure 6:
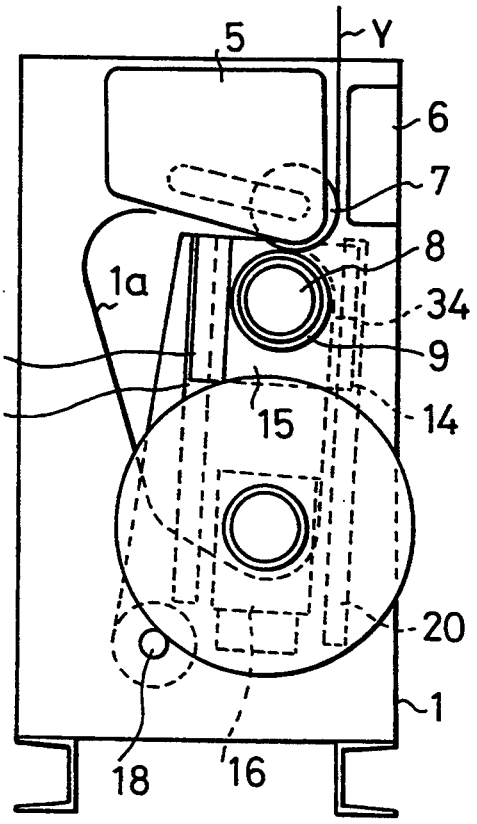

The chucks 14*a* are opened by means of the fluid pressure cylinder 14*d* of the carrier connecting means, and the connection between the carrier 16 and the slider 14 is disengaged. Under this condition, the slider 14 is returned by means of the stepping motor 23 to a position corresponding to the other carrier 15 located at the winding position while the carrier 16 is kept at the doffing position. At the winding position, the slider 14 and the carrier 15 are connected to each other by means of the carrier connecting means (FIG. 6).

Figure 7:
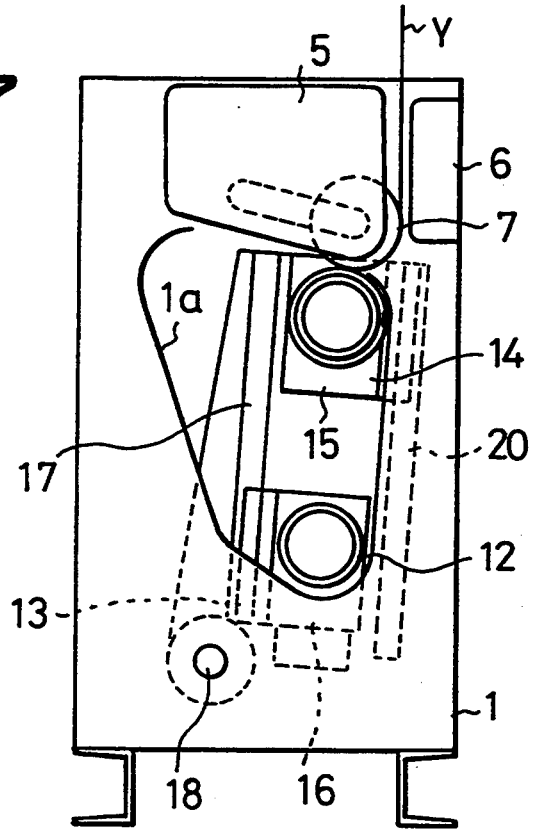

Then, the package 10 which has been located at the doffing position is pushed by means of the plate 35, and an empty bobbin 12 is inserted onto the emptied bobbin holder 11 (see FIG. 7). The slider 13, which has been connected to the carrier 15 by means of the carrier connecting means on the slider 13, is disengaged from the carrier 15, and it is lowered by means of the stepping motor 27 to the doffing position where it is engaged with the carrier 16 which has been located there (FIG. 7).

Figure 8:
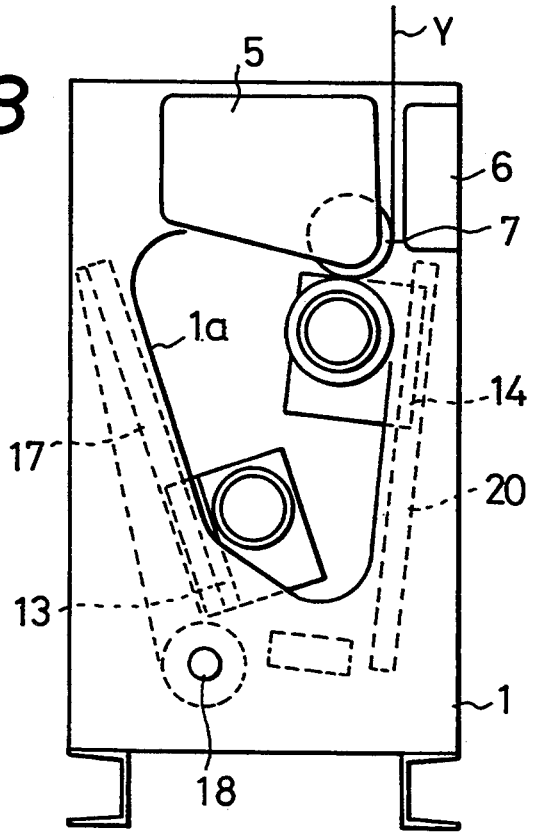

After the carrier 16 is disengaged from the carrier engaging means 33 disposed on the machine frame 1, the second slider guide means 17 is swung about the shaft 18 in a counter-clockwise direction (FIG. 8). The slider 13 having the bobbin holder 11 supported thereon is lifted by means of the stepping motor 27 to the stand-by position where the bobbin holder 11 is moved axially so that the yarn catching means formed on the bobbin 12 is located at a position where the yarn released from the traverse guide upon changing will be located (see FIG. 1).

The size of the package wound on the bobbin 9 inserted onto the bobbin holder 8 increases and the contact roller 7 which is pressed to and contacts the package 10 lifts a small distance, and the sensor 47 is activated. Then, the stepping motor 23 connected to the carrier located at the winding position is started, and the bobbin holder 8 lowers and the stepping motor 23 is stopped when the sensor 47 is deactivated.

When the amount of the yarn wound on the bobbin holder 8 reaches a predetermined amount, the bobbin holder 11 which has been located at the stand-by position is started, and the above-described operations are repeated.

The above-explanation has been done with respect to the changing of the package which has been wound to the maximum amount according to from the machine specification. However, if the changing operation has to be done while the wound diameter of the package is small, the second slider means 17 may be swung in a direction A when the distance between the bobbin holder 11 and the contact roller 7 reaches a predetermined distance (in this embodiment, when the distance between the outer periphery of the bobbin holder 11 and that of the contact roller 7 becomes equal to the outer diameter of the bobbin) so as to change the winding of the yarn.

Figure 12:
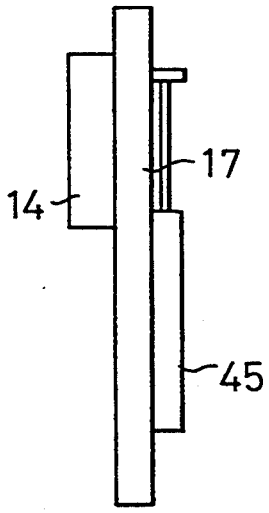
FIG. 12 is a schematic elevation of another embodiment of the slider guide means.

Although the mechanism for moving the slider along the slider guide means was the bolt, i.e., the screw bar, rotated by the stepping motor in the above-described embodiment, a fluid pressure cylinder 45 (FIG. 12) which is commonly used in a typical winding apparatus may be used to reciprocate the slider since the movement of the slider along the slider guide means is linear. Particularly, when the first slider guide means 20 is moved by means of such a fluid pressure cylinder, the apparatus can be very simple since the cylinder can be controlled in a manner common in a conventional mechanism for exerting the contact pressure.

Figure 13:
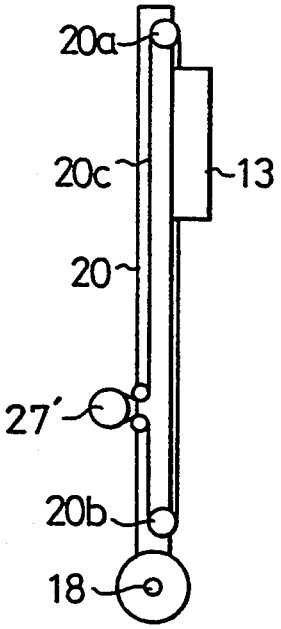
FIG. 13 is an elevation of a still another embodiment of the slider guide means.

Further, as illustrated in FIG. 13, chains 20*c* may be engaged with sprockets 20*a* and 20*b* rotatably supported at the upper and lower ends of the slider guide means, and the chain 20*c* is driven by a motor 27' so as to vertically move the slider 13.

Figure 14:
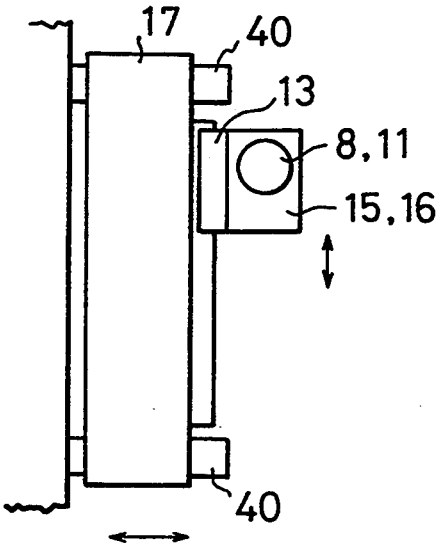
FIG. 14 is an elevation of a further embodiment of the slider guide means.

Another embodiment will now be explained with reference to FIG. 14. Although the second slider guide means 17 was swingable about the shaft 18 in the above-described embodiment, the second slider guide means 17 can be moved towards and away from the first slider guide means 20 while they are in parallel with each other in this embodiment. More specifically, the second slider means 17 can be moved horizontally along a horizontal slide shaft 40, and the body of the second slider guide means 17 has the slider 13 of the present invention mounted thereon. The means for connecting the slider 13 and the carriers 15 and 16 and the means for vertically moving the slider 13 are disposed in a manner similar to that for the above-described embodiment.

Figure 15:
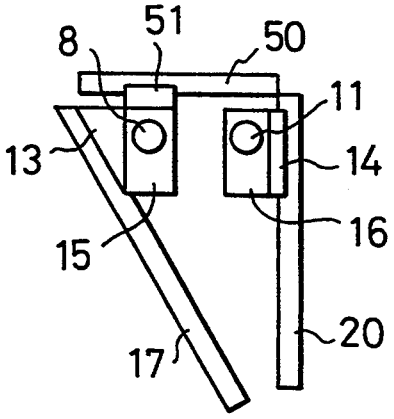
FIG. 15 is an elevation of a still further embodiment of the slider guide means.

Contrary to the fact that the second slider guide means 17 was swingable in the above-described embodiment, the first and second slider guide means 20 and 17 are fixedly disposed at predetermined positions along the V-shaped sides in the embodiment illustrated in FIG. 15, and a horizontal third slider guide means 50 is disposed at the opened upper side so as to connect the upper ends of the first and second slider guide means 20 and 17. The carrier 15 or 16 is transferred from the second slider guide means 17 to the slider 51 of the third slider guide means 50, and then the carrier 15 or 16 is transferred from the third slider guide means 50 to the first slider guide means 20.

Another embodiment of the carrier engaging means 33 disposed in the machine frame 1 will now be explained with reference to FIGS. 16–20. Parts similar to those in the above-described embodiments are designated by the same reference numerals and their detailed explanation is thus omitted.

Figure 19:
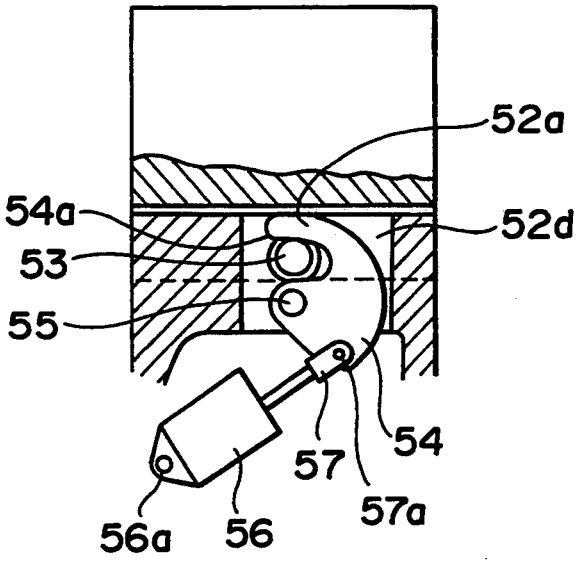
FIG. 19(*a*) is a cross sectional view taken along line 19*a*—19*a* in FIG. 17, and FIG. 19(*b*) is a view seen in arrow 19*b* in FIG. 16.
Figure 19:
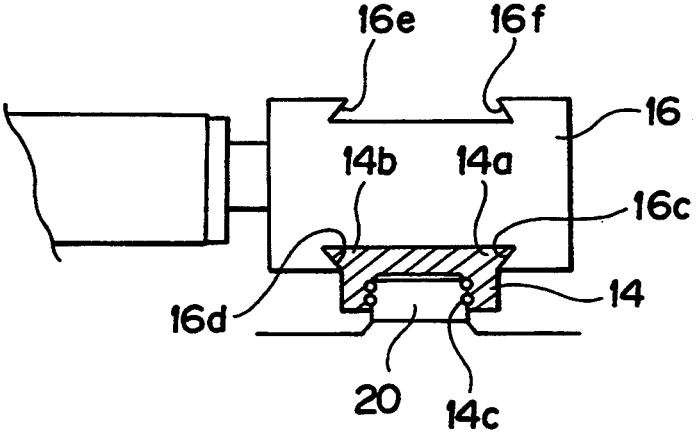

The carrier 16 is slidable along with the slider 14 as in the above-described embodiment. For this purpose, as illustrated in FIG. 19(*b*), the carrier has dove grooves designated by 16*c*, 16*d*, 16*e* and 16*f* at the walls thereof, and projections are formed on the carrier wall of the slider 14, so that the carrier 16 and the slider can be engaged with each other. The slider 14 is slidable along the first slider guide means 20 via a slide bearing 14*c*.

Figure 16:
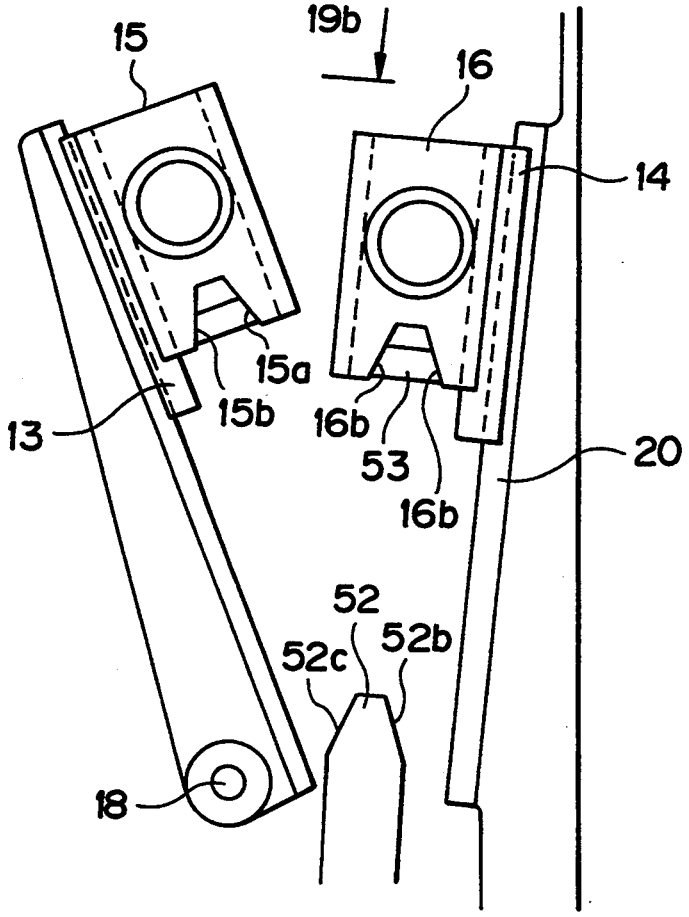
FIGS. 16 and 17 are elevations of an embodiment of a carrier connecting means in different operating conditions.
Figure 17:
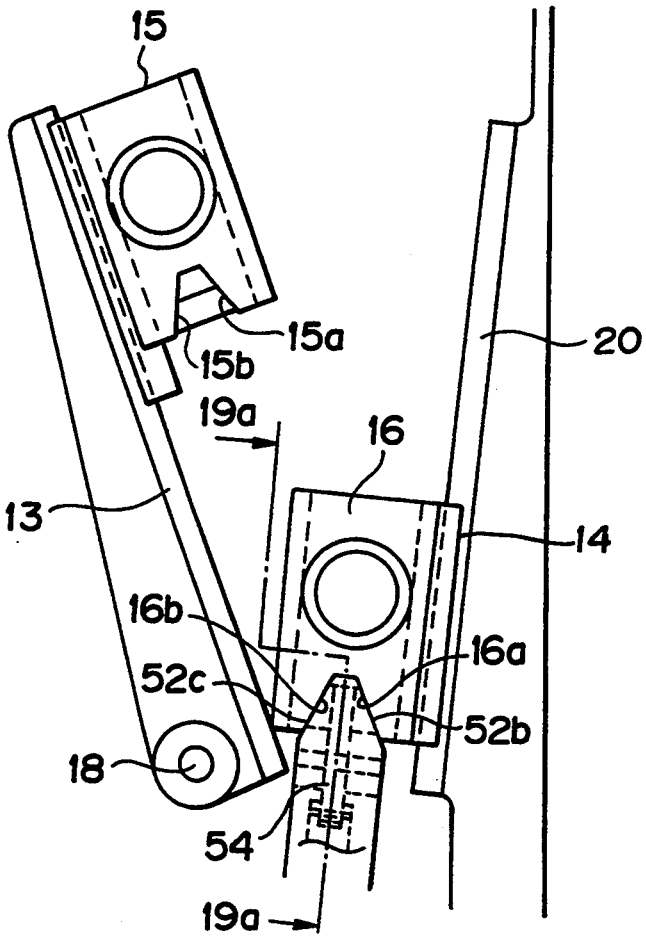

In this embodiment, when the carrier 15 or 16 lowers to its lowermost position, it is held by a holding device 52 fixed to the machine frame 1. More specifically, as illustrated in FIGS. 16 and 17, the carriers 15 and 16 have downwardly extending inclined portions 15*a*, 15*b* and 16*a*, 16*b* at the bottoms thereof and pins 53 formed between the inclined portions 15*a* and 15*b*, 16*a* and 16*b*. The upper end of the holding device 52 has tapered portions 52*b* and 52*c*. The inclined portions 15*a* and 15*b*, or 16*a* and 16*b* of the carrier 15 or 16 and the tapered portions of the holding device 52 can be engaged with each other.

Figure 18:
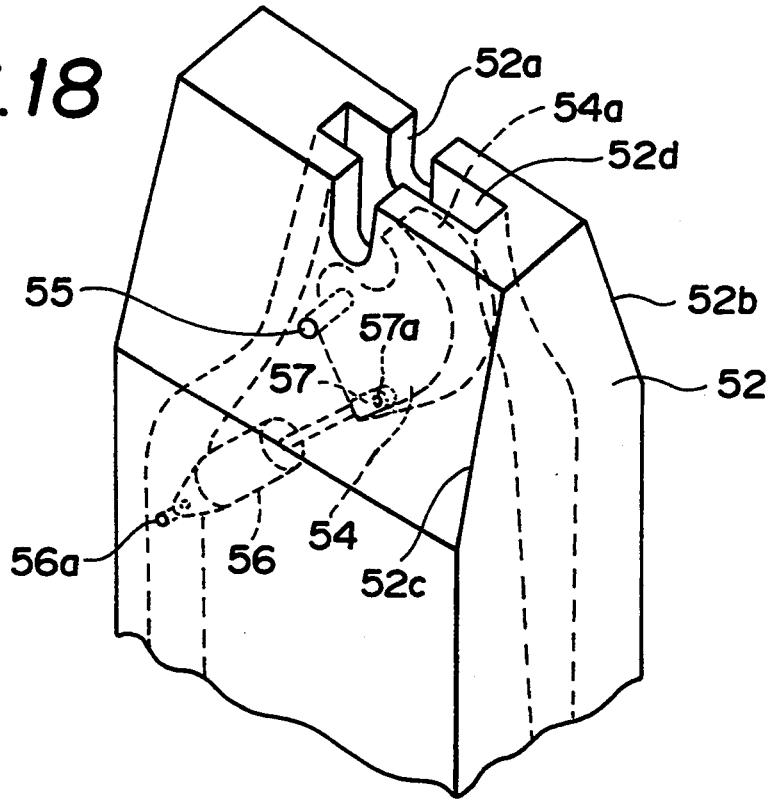
FIG. 18 is a perspective view of a holding member illustrated in FIGS. 16 and 17.

The inner construction of the holding device 52 will now be explained with reference to FIGS. 18 and 19(*a*). A pair of U-shaped recesses 52*a* for receiving the pin 53 of the carrier 15 or 16 are formed at the upper end of the holding device 52. An elongated hole 52*d* is formed in such a manner that it is perpendicular to the U-shaped recesses 52*a* when they are seen from the above.

A hook 54 formed as a quarter of a circle is disposed in the elongated hole 52*d* in such a manner that it is pivoted about a pin 55 fixed to the holding device 52. The upper end 54*a* of the hook 54 projects like a nose to form an engaging portion which can engage with the pin 53 of the carrier 15 or 16 when the hook 54 is fully turned in a counter-clockwise direction.

A rear end 56*a* of a fluid pressure cylinder 56 is pivoted to the holding device 52, and a joint 57 connected to an end of the fluid pressure cylinder 56 is pivoted to the rear end of the hook 54.

The operation of the embodiment with the above-described construction will now be explained with reference to FIGS. 16 and 17. While the joint 57 is retracted by actuation of the fluid pressure cylinder 56 illustrated in FIGS. 18 and 19(*a*) so that the hook 54 is swung in a clockwise direction about the pin 55 and the U-shaped recesses 52*a* are exposed, the carrier 16 is lowered to its lowermost position as illustrated in FIG. 17. Thus, the inclined portions 16*a* and 16*b* of the carrier 16 and the tapered portions 52*b* and 52*c* of the holding device 52 engage each other. Then, the fluid pressure cylinder 56 illustrated in FIGS. 18 and 19(*a*) is operated so that the joint 57 is moved forwardly and the hook 54 is swung in a counter-clockwise direction about the pin 55. Accordingly, the engaging portion 54*a* of the hook 54 engages with the pin 53 of the carrier 16, and the carrier 16 is held at a predetermined lowermost position and takes the conditions similar to those illustrated in FIG. 3.

Figure 20:
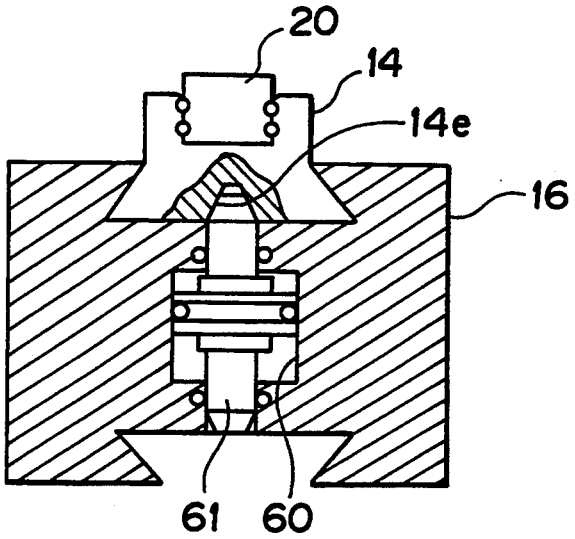
FIGS. 20–22 illustrate embodiments for integrally connecting a carrier to a slider, FIGS. 20 and 21(*a*) being cross sectional views, FIG. 21(*b*) being a view seen in arrow 21*b*—21*b* in FIG. 21(*a*), and FIG. 22 being an elevation.
Figure 22:
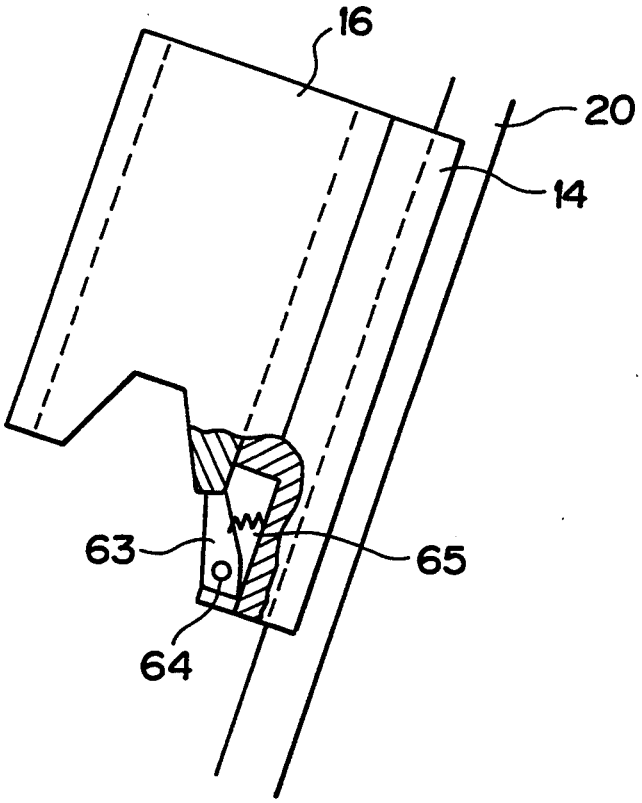
Figure 21:
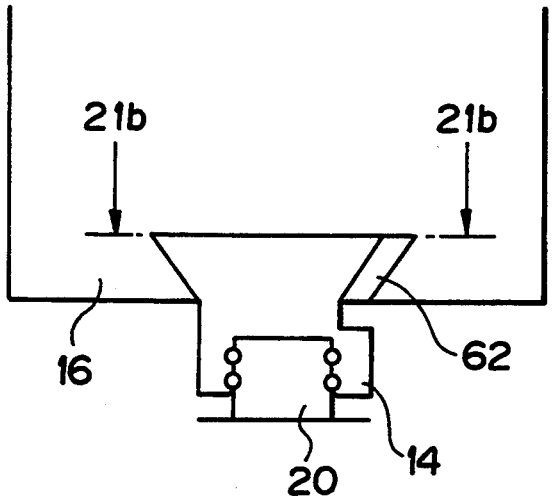
Figure 21:
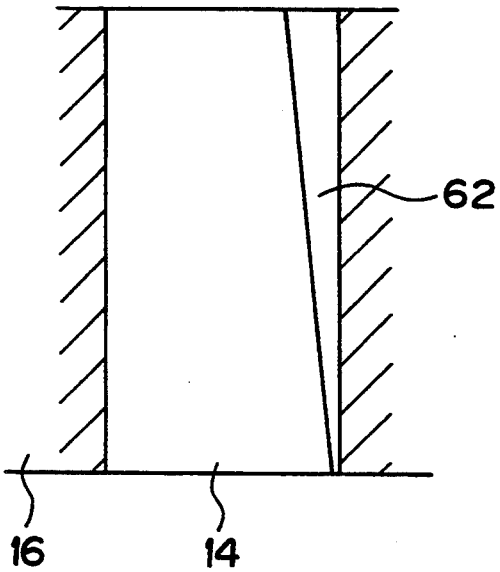

Some other embodiments for connecting the carrier 15 or 16 to the slider 13 or 14 are illustrated in FIGS. 20–22. Further, magnets or the like may be used.

More specifically, in FIG. 20, a cylinder chamber 60 is formed within the carrier 16, and a piston with two rods is sealingly and slidably inserted into the cylinder chamber 60. The projecting end of the piston 61 is engaged with the recess 14*e* of the slider 14 so that the carrier 16 and the slider 14 are integrally connected to each other.

In the embodiment illustrated in FIGS. 21*a* and 21*b* a wedge 62 is inserted into a space formed between the projection formed on the surface of the slider 14 and the groove formed on the carrier 16.

In FIG. 22, an engaging hook 63 is disposed pivotally about a pin 64 at the lower end of the slider 14 and is forced by a spring to a position where it engages the carrier 16.

The connecting mechanism for connecting the slider and the carrier to each other is not limited to those described above, a mechanical device, an electro-magnetic device, a fluid pressure device and so on may be used as long as they can surely connect the slider and the carrier to each other.

Although the bobbin holders were connected to carriers in the above-described embodiments, the bobbin holders may be engaged with the slider by using the taper engagement or directly held by the slider using chucks or the like. In the latter case, the bobbin holders serve as the carriers of the present invention.

The winding apparatus of a spindle drive type has been exemplified, however, the present invention is also applicable to a winding apparatus of a friction drive type.

The present invention obviates the problems inherent to the winding apparatus proposed by the present inventor in U.S. Pat. No. 5,246,177 and provides an apparatus of a bobbin changing type for winding a yarn, by which not only the installation space can be minimized, but also the manufacturing cost can be reduced yet highly precise control upon winding can be achieved.

I claim:

1. A yarn winding apparatus in which bobbins are automatically changed when the yarn wound on a bobbin reaches a predetermined amount, the apparatus comprising:

a first elongated slider guide having a slider mounted thereon and movable along the first slider guide;

a second elongated slider guide having a slider mounted thereon and movable along the second slider guide;

a device for moving the slider along the first slider guide and a device for moving the slider along the second slider guide;

a first carrier having a bobbin holder attached thereto, the first carrier being releasably engaged with the slider mounted on the first slider guide;

a second carrier having a bobbin holder attached thereto, the second carrier being releasably engaged with the slider mounted on the second slider guide;

wherein the first and second carriers with their attached bobbin holders are engageable with each of the sliders mounted on the first and second slider guides, and one of the first and second slider guides is provided with means for moving the one slider guide toward the other slider guide to permit transfer of the carrier and bobbin holder from the one slider guide to the other slider guide;

whereby when the yarn wound on a bobbin positioned on one of the bobbin holders reaches a predetermined amount, the bobbin holder is moved with its carrier away from a winding position along one of the slider guides, and the other bobbin holder with a bobbin positioned thereon is transferred with its carrier from the other slider guide to the one slider guide to occupy said winding position.

2. A yarn winding apparatus according to claim 1, wherein said first elongated slider guide is fixed at a predetermined position, and one end of said second elongated slider guide is pivotally mounted and is provided with said means for moving the second slider guide between a first position where it is substantially parallel with said first slider guide, and a second position where it is located away from said first position and is not parallel with said first slider guide.

3. A yarn winding apparatus according to claim 2, wherein each of said first and second carriers includes a portion configured to be releasably engaged by a pair of chucks carried by each of the sliders, the chucks having a selectively movable portion that matingly engages said configured portion of said carriers.

4. A yarn winding apparatus according to claim 2, wherein each of said first and second carriers includes a dovetail-shaped recess that is engageable by a complementarily-shaped dovetail portion formed each of the sliders.

5. A yarn winding apparatus according to claim 1, wherein each of said first and second carriers includes a dovetail-shaped recess that is engageable by a complementarily-shaped dovetail portion formed on each of the sliders.

6. A yarn winding apparatus according to claim 1, wherein said first slider guide is fixed at a predetermined position, and said second slider guide is provided with means for being moved between a first position where it is in parallel with and spaced a predetermined distance from said first slider guide, and a second position where it is in parallel with said first slider guide but is spaced from said first slider guide a distance that is different from said predetermined distance.

7. A yarn winding apparatus according to claim 1, wherein each of said first and second carriers includes a portion configured to be releasably engaged by a pair of chucks carried by each of the sliders, the chucks having a selectively movable portion that matingly engages said configured portion of said carriers.

8. A yarn winding apparatus in which bobbins are automatically changed when the yarn wound on a bobbin reaches a predetermined amount, the apparatus comprising:

a first elongated slider guide having a slider mounted thereon and movable along the first slider guide;

a second elongated slider guide having a slider mounted thereon and movable along the second slider guide;

a third elongated slider guide having a slider mounted thereon and movable along the third slider guide;

means for moving the slider along the first slider guide, the slider along the second slider guide, and the slider along the third slider guide;

a first carrier having a bobbin holder attached thereto, the first carrier being releasably engaged with the slider mounted on the first slider guide;

a second carrier having a bobbin holder attached thereto, the second carrier being releasably engaged with the slider mounted on the second slider guide;

wherein the first and second slider guides are mounted on the apparatus to substantially form a V-shaped configuration, and the third slider guide is mounted on the apparatus adjacent the first and second slider guides to substantially form a triangular configuration, and the first and second carriers with their attached bobbin holders are engageable with each of the sliders mounted on the first, second and third slider guides;

whereby the first and second carriers are selectively movable along, and transferable to and from, the first, second and third slider guides to be positioned at a winding position, a doffing position, and a stand-by winding position.

9. A yarn winding apparatus according to claim 8, wherein each of said first and second carriers includes a portion configured to be releasably engaged by a pair of chucks carried by each of the sliders, the chucks having a selectively movable portion that matingly engages said configured portion of said carriers.

10. A yarn winding apparatus in which bobbins are automatically moved to and from a winding position, a doffing position, and a stand-by winding position, the apparatus comprising:

a first elongated slider guide means for guiding a slider mounted thereon as the slider is moved along the first slider guide means;

a second elongated slider guide means for guiding a slider mounted thereon as the slider is moved along the second slider guide means;

means for moving the slider along the first slider guide means;

means for moving the slider along the second slider guide means;

a first carrier having a bobbin holder attached thereto and having means for being releasably engaged with the slider mounted on the first slider guide means;

a second carrier having a bobbin holder attached thereto and having means for being releasably engaged with the slider mounted on the second slider guide means;

wherein the means for releasably engaging the first and second carriers with the sliders mounted on the first and second slider guide means permits each of the first and second carriers to be engaged with either of the sliders mounted on the first and second slider guide means; and wherein one of the first and second slider guide means is provided with means for being moved toward the other slider guide means to permit transfer of each carrier and bobbin holder from the one slider guide means to the other slider guide means.

* * * * *

UNITED STATES PATENT AND TRADEMARK OFFICE

CERTIFICATE OF CORRECTION

PATENT NO. : 5,431,352

DATED : July 11, 1995

INVENTOR(S) : Takami Sugioka

It is certified that error appears in the above-indentified patent and that said Letters Patent is hereby corrected as shown below:

Col. 1, between lines 35 and 36, there should be no paragraph break; Col. 1, line 68, delete "space"; delete "for"; after "installation" insert -- space --; Col. 3, line 60, before "EMBODIMENTS", insert -- PREFERRED --; Col. 4, line 6, "of" should be -- in --; Col. 7, line 39, delete "from"; Col. 9, line 33, after "21b" insert a comma;

Col. 10, line 51 (claim 4), after "formed" insert -- on --.

Signed and Sealed this

Twelfth Day of December, 1995

*Attest:*

Bruce Lehman

*Attesting Officer*

BRUCE LEHMAN

*Commissioner of Patents and Trademarks*